US009144734B2

(12) United States Patent
Crosbie

(10) Patent No.: US 9,144,734 B2
(45) Date of Patent: Sep. 29, 2015

(54) INTERACTIVE AMUSEMENT GAME

(71) Applicant: Easebon Services Limited, Kwun Tong (HK)

(72) Inventor: Scott Charles Crosbie, St. Louis Park, MN (US)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 14/293,016

(22) Filed: Jun. 2, 2014

(65) Prior Publication Data

US 2014/0361488 A1 Dec. 11, 2014

Related U.S. Application Data

(60) Provisional application No. 61/832,406, filed on Jun. 7, 2013.

(51) Int. Cl.

| | |
|---|---|
| ***A63B 67/00*** | (2006.01) |
| ***A63F 9/30*** | (2006.01) |
| ***A63F 9/02*** | (2006.01) |
| ***A63F 7/00*** | (2006.01) |

(52) U.S. Cl.

CPC ..... *A63F 9/30* (2013.01); *A63F 7/0058* (2013.01); *A63F 9/0208* (2013.01); *A63F 9/0243* (2013.01); *A63F 2009/0239* (2013.01); *A63F 2009/0282* (2013.01)

(58) Field of Classification Search

CPC ..... A63F 9/30

USPC ..... 273/144 R, 144 A, 144 B, 317, 355, 412, 273/447; 124/6

See application file for complete search history.

(56) References Cited

U.S. PATENT DOCUMENTS

| | | | | |
|---|---|---|---|---|
| 1,542,063 | A | | 6/1925 | Knight |
| 2,129,489 | A | * | 9/1938 | Brown ..... 124/56 |
| 3,358,998 | A | | 12/1967 | Goldfarb |
| 3,391,934 | A | | 7/1968 | Ryan et al. |
| 3,474,771 | A | * | 10/1969 | Breslow et al. ..... 124/16 |
| 3,592,470 | A | | 7/1971 | Breslow |
| 3,612,528 | A | | 10/1971 | Glass et al. |
| 3,679,208 | A | * | 7/1972 | Carrano et al. ..... 273/412 |
| 4,030,760 | A | | 6/1977 | Danowski |
| 4,118,026 | A | | 10/1978 | Todokoro |
| 4,200,284 | A | * | 4/1980 | Kaga ..... 273/447 |
| 4,266,767 | A | * | 5/1981 | Spring ..... 273/447 |
| 4,802,880 | A | | 2/1989 | Shaw |
| 4,826,176 | A | | 5/1989 | Kobayashi |
| 4,900,026 | A | * | 2/1990 | Kulesza et al. ..... 273/119 A |
| 4,961,580 | A | * | 10/1990 | Yoe et al. ..... 273/447 |
| 5,052,967 | A | * | 10/1991 | Slatter et al. ..... 446/73 |
| 5,318,294 | A | * | 6/1994 | Boroski ..... 473/505 |
| 5,657,995 | A | * | 8/1997 | Howard ..... 273/333 |
| 5,752,704 | A | * | 5/1998 | Todokoro ..... 273/447 |
| 6,817,351 | B2 | * | 11/2004 | Keller et al. ..... 124/6 |
| 2007/0216102 | A1 | | 9/2007 | Matilla et al. |

* cited by examiner

*Primary Examiner* — Mark Graham

(74) *Attorney, Agent, or Firm* — Amster, Rothstein & Ebenstein LLP

(57) ABSTRACT

An interactive amusement game in which players collect projectiles emitted randomly from a centralized location. A preferred embodiment has a centralized location constructed in the shape of a garbage can which randomly ejects plastic flies through apertures in the housing lid. Players surround the centralized location with plastic fly swatters constructed with non-permanent adhering means that attach to the flies emitted from the centralized location.

10 Claims, 2 Drawing Sheets

INTERACTIVE AMUSEMENT GAME

CROSS-REFERENCE TO RELATED APPLICATION

This application claims the priority of and benefit to U.S. Provisional Patent Application No. 61/832,406, filed on Jun. 7, 2013, the entire contents of which are incorporated by reference herein.

FIELD OF THE INVENTION

The present invention relates generally to interactive amusement games and more particularly to interactive games where players try to collect projectiles emitted randomly from a centralized location.

BACKGROUND OF THE INVENTION

Interactive amusement games are fun to play especially where projectiles are involved. Some games in the prior art call for multiple individuals to launch projectiles towards a centralized location. Examples of games where projectiles are launched towards a centralized location are described in U.S. Pat. Nos. 1,542,063, 3,592,470, 3,612,528 and 4,826,176 and various versions of Tiddlywinks and ANTS IN THE PANTS® games. In other games, projectiles are launched from a centralized location, as described in U.S. Pat. Nos. 3,358,998, 3,391,934, and 4,118,026.

SUMMARY OF THE INVENTION

An interactive amusement game including projectiles being launched from a centralized location for capture by individual players is provided. The projectiles are launched from a centralized location in random fashion and are captured using a hand-held apparatus. The random nature of the launching of the projectiles is what makes the interactive amusement game particularly exciting. In multiplayer games, the players can compete against each other or cooperate in teams in an attempt to capture the most projectiles.

In one embodiment, projectiles in the form of representations of flies are launched from a centralized location on an ejection path through apertures in a lid of a housing designed to look like a garbage can. A mechanism is present in the housing to cause the flies to be ejected from the housing. The flies are designed in such a way that they stick to hand-held apparatuses provided to and wielded by the players. In the preferred embodiment, these apparatuses are in the shape of fly swatters and are used by each player to collect the flies.

It is anticipated and within the scope of this invention that the housing could be any suitable shape consistent with the theme of the game and the projectiles could be other living creatures (e.g., butterflies, bees, grasshoppers, crickets, frogs, tadpoles), imaginary creatures (monsters, aliens, etc.), or balls or other shapes of a form suitable to be ejected through apertures in the lid of the housing.

It is anticipated and within the scope of this invention that the hand-held apparatuses can be such devices as nets, mitts or the like.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures wherein.

DETAILED DESCRIPTION OF THE EXEMPLARY EMBODIMENTS

Figure 1:
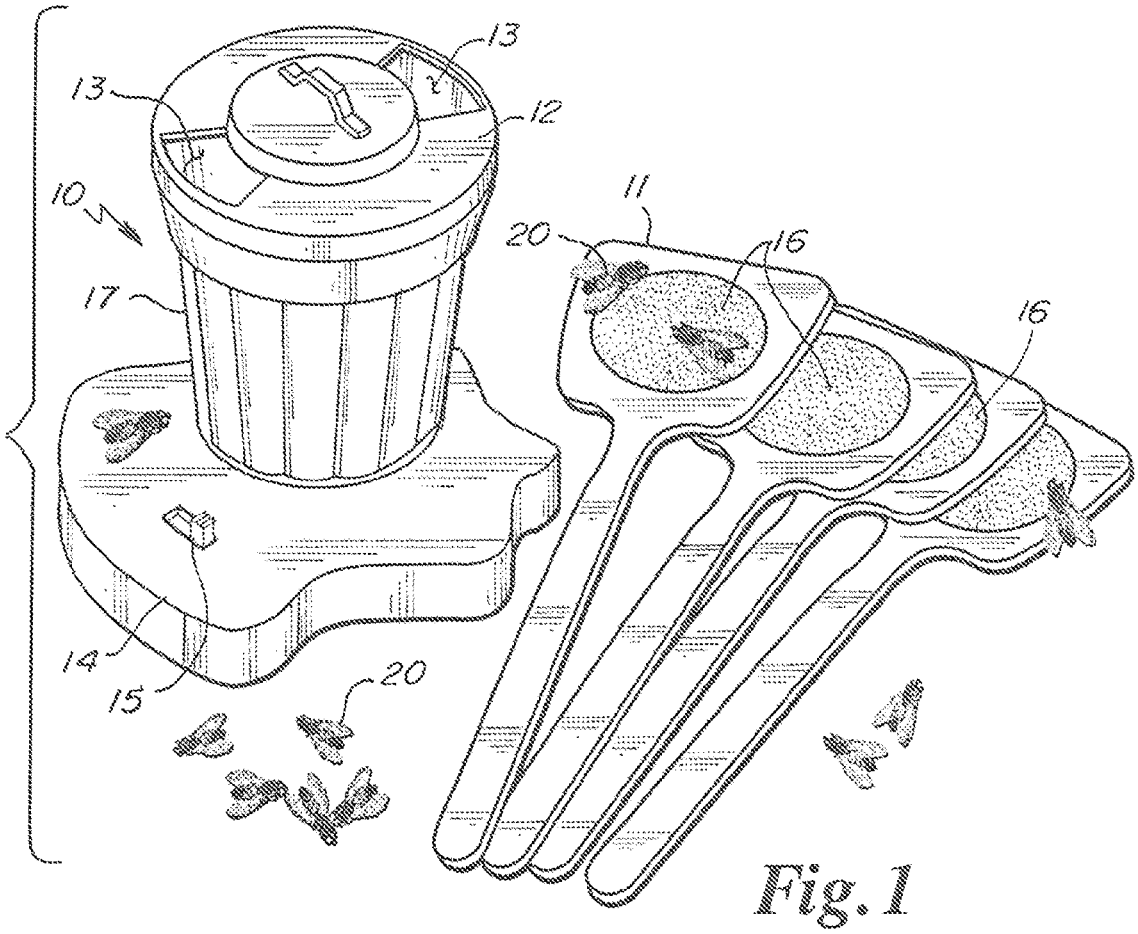
FIG. 1 is a perspective view of the Interactive Amusement Game equipment of this invention.

Initially referring to FIG. 1, the embodiment of the Interactive Amusement Game described herein includes a Fly Swatting Mechanism 10, numerous flies 20, and one or more fly swatters 11. Fly Swatting Mechanism 10 comprises a housing with housing wall 17 and housing lid 12. The housing lid contains one or more apertures 13 substantially evenly spaced around the edges of housing lid 12. The housing is mounted on mechanical base 14 which contains switch 15 to turn on and off the game.

Each fly swatter 11 contains a non-permanent adhering means 16. The non-permanent adhering means 16 can be manufactured from any material which can pick up a fly in a non-permanent manner. Examples of a suitable material could be Velcro®, an adhesive or any material that has a sticky surface. The material could also be magnetic in nature. Fly 20 is covered in part in a material complementary to the material from which non-permanent adhering means 16 is constructed so that fly 20 will stick to the non-permanent adhering means 16 of fly swatter 11. Multiple flies 20 are shown in FIG. 1.

To commence playing the game, players each take a fly swatter 11. In the preferred embodiment, up to four players are envisioned, but any number of players can participate provided there are sufficient fly swatters 11 available. Flies 20 are placed inside the housing. One of the players then places switch 15 into the "on" position. In other embodiments, switch 15 can be otherwise controlled such as by a timer or sensor which commences operation once each player is ready to commence playing the game.

Figure 2:
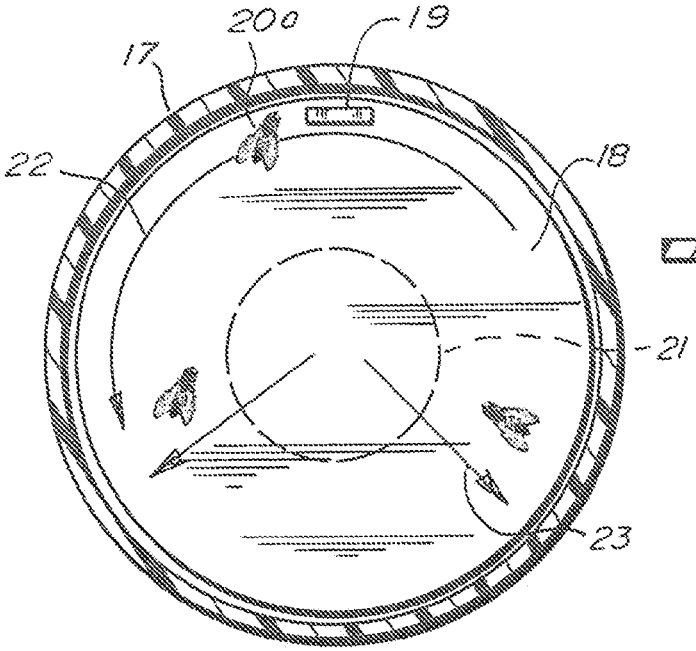
FIG. 2 is a top view looking inside the Interactive Amusement Game mechanism taken along the line 2-2 in FIG. 4.

FIG. 2 illustrates the construction of turntable 18 which commences rotation at the base of the housing when the game is energized using switch 15. Drive motor 21 rotates turntable 18, shown in this embodiment as rotating in a counter-clockwise direction 22. As the turntable rotates in the counter-clockwise direction 22, centrifugal force, as shown by centrifugal force vector 23 in FIG. 2, will tend to drive the flies towards housing wall 17. When a fly nears kick tooth 19 mounted on turntable 18, the fly is placed into launch position 20*a*. If a fly misses kick tooth 19 it will hit housing wall 17 and fall back to the surface of turntable 18 where it will engage kick tooth 19 on a successive rotation of turntable 18.

Figure 3:
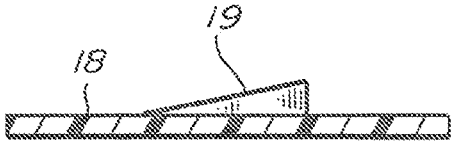
FIG. 3 is a detail of the kick tooth located on the turntable of the Interactive Amusement Game mechanism.

As best shown in FIG. 3, kick tooth 19 has a sloping surface with its height increasing from front to back. Kick tooth 19 can be positioned at any point along top surface of turntable 18 as long as the radial distance between kick tooth 19 and housing wall 17 is less than the length and width of a fly to ensure that the fly will engage kick tooth 19 as turntable 18 rotates. The distance between housing wall 17 and kick tooth 19 is important since if the difference is too large, the fly can ride on turntable 18 without engaging kick tooth 19. Alternatively, the inner surface of housing wall 17 can have an inwardly extending projection (not shown) to direct the fly into engagement with kick tooth 19.

Figure 4:
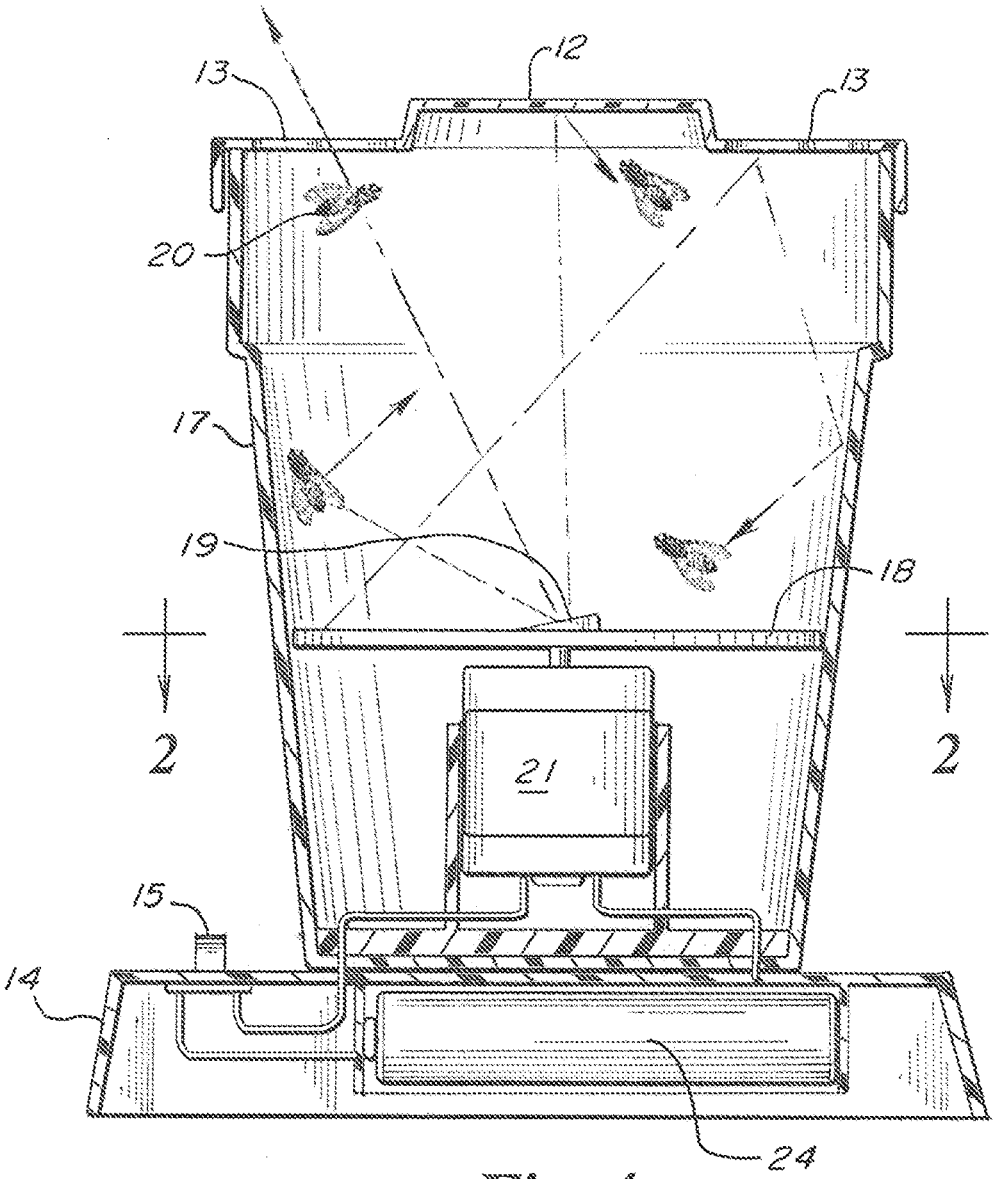
FIG. 4 is a cross-sectional view of the Interactive Amusement Game mechanism.

In operation, turntable 18 rotates at a sufficiently high speed so that when kick tooth 19 contacts fly 20, it tends to send fly 20 in an upward trajectory as illustrated in FIG. 4. As seen from FIG. 4, flies launched from kick tooth 19 travel in unpredictable directions, and may bounce against housing wall 17, or housing lid 12. Ultimately, fly 20 will be ejected from the housing when fly 20 is launched on an ejection path which is defined as an appropriate trajectory such that fly 20 will pass through aperture 13, at which time the players of the game attempt to catch the flies 20 using fly swatter 11 shown in FIG. 1. Each fly 20 that does not exit the housing through aperture 13 will lose its flight energy and fall back down to turntable 18. The rotation of turntable 18 will again drive fly 20 towards housing wall 17, where fly 20 will approach launch position 20*a* for another attempt to be launched on an ejection path through aperture 13. As seen in FIG. 4, turntable 18 is rotated by a direct-drive motor 21 which is powered using battery 24 located within mechanical base 14, and energized by turning on switch 15. Battery 24 is located in a battery box which is preferably accessed from the underside of mechanical base 14.

Figure 5:
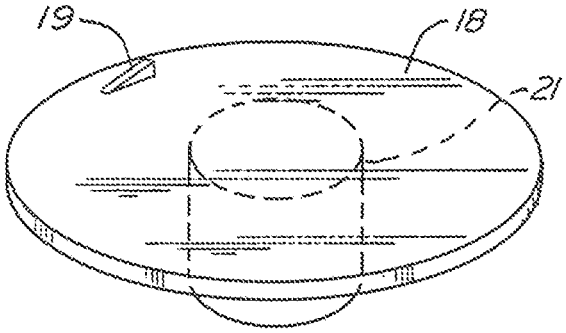
FIG. 5 is a perspective view of the turntable.

FIG. 5 shows that turntable 18 is operatively connected to motor 21. Turntable 18 may be directly driven by motor 21 or at higher or lower rotational speeds using appropriate drive means such as gears, belts or other conventional drives. Kick tooth 19 is visible on the surface of turntable 18. As seen in FIG. 5, kick tooth 19 is preferably sloped and constructed of a soft molded plastic so that a user would not hurt a finger if inserted into the housing while turntable 18 was moving. However, kick tooth 19 can be constructed in any size or shape and using any suitable material provided that it maintains its ability to eject fly 20 from the housing through aperture 13.

Additionally, housing lid 12 may be provided with an electrical cut off switch so that when housing lid 12 is lifted electrical power to motor 21 is interrupted so that a user will not be hurt by the rotating turntable 18. Other safety features are provided by the size of apertures 13 which prevent a user from ejecting a projectile from the housing which is too large and potentially dangerous or which can be sized to prevent users from inserting fingers into the housing.

The game equipment materials are preferably made out of molded plastic. However, a great variety of materials may be used in constructing the game equipment of this invention. Such material selection would be obvious to those skilled in the art.

Many variations may be made from the specific embodiment shown. For example, fly 20 could be replaced with a projectile of similar size shaped like a frog, butterfly or another object consistent with the theme of the game. The only limiting criteria is that the object be of a weight and size not so great as to prevent the object from being launched through aperture 13. Fly swatter 11 could be replaced with a net to capture whatever objects are emitted from the housing instead of swatting the objects and having them stick to the non-permanent adhering means 16 on fly swatter 11. Similarly, the apparatus can be used with a plurality of ball shaped projectiles which can be ejected in the same manner and captured by a player using a net, miniature mitt or other suitable means.

Instead of motor 21 being powered by the use of battery 24 to impart rotational movement to the turntable, motor 21 could be powered using multiple batteries, electric current from a wall socket or through any other available means of electrical power such as solar. Alternatively, in lieu of motor 21, turntable 18 can be rotated by a spring wound mechanism, fly wheel or other similar means in order to impart rotational movement to the turntable.

Housing lid 12 can be weighted down so that it remains on top of housing wall 17. Alternatively, housing lid 12 can be secured using a twist and lock feature, friction fit, or any other design which suits a similar purpose including permanently securing housing lid 12 to housing wall 17.

Other variations of the game can include a user controlled variable speed drive for turntable 18. By changing the speed a user may vary the height or distance projectiles are launched from the housing. Similarly, apertures 13 can be made variable in size to control the frequency at which given projectiles, such as bugs 20, are launched from the housing. Larger apertures 13 will generally result in more frequent launching of projectiles. Further, housing wall 17 can have a varied shape such as steps, or texture such as roughness, to slow the delivery of the projectiles to kick tooth 19.

Now that embodiments of the present invention have been shown and described in detail, various modifications and improvements thereon will become readily apparent to those skilled in the art. Accordingly, the exemplary embodiments of the invention, as set forth above, are intended to be illustrative, not limiting. The spirit and scope of the present invention is to be construed broadly.

The invention claimed is:

1. An interactive amusement game comprising:

a housing with a housing wall rising on the perimeter of the housing; and a housing lid located on top of the housing;

the housing lid containing at least one aperture sized large enough so that an ejectable object can pass through said aperture;

a turntable located within the housing;

the turntable containing a kick tooth;

at least one ejectable object; and the kick tooth positioned on the top surface of the turntable with the radial distance between the kick tooth and the housing wall being less than the length, width or diameter of the ejectable object;

rotation means for rotating the turntable relative to the housing;

the turntable being rotatable at sufficient speed by the rotation means such that the ejectable object is ejected by the kick tooth through the aperture by rotation means connected to the turntable when the aperture is aligned with the ejection path of the ejectable object.

2. The interactive amusement game of claim 1, wherein the kick tooth has a sloping surface.

3. The interactive amusement game of claim 1 additionally comprising a hand-held apparatus sufficiently sized to make contact with the ejectable object.

4. The interactive amusement game of claim 3, wherein the hand-held apparatus and ejectable object are constructed in such a manner that they stick to each other in a non-permanent manner when they come into contact with each other.

5. The interactive amusement game of claim 4, wherein the hand-held apparatus is in the shape of a fly swatter and the ejectable object is in the shape of a fly.

6. The interactive amusement game of claim 1, wherein the turntable is located at the base of the housing.

7. The interactive amusement game of claim 1, wherein the rotation means is a motor.

8. The interactive amusement game of claim 7, wherein the motor is a variable speed motor.

9. The interactive amusement game of claim 1, wherein the housing lid is detachable.

10. An interactive amusement game comprising:

a housing in the shape of a garbage can with a housing wall rising on the perimeter of the housing; and a housing lid located on top of the housing;

the housing lid containing at least one aperture sized large enough so that the ejectable object can pass through said aperture;

a turntable located within the housing;

the turntable containing a sloped kick tooth;

at least one ejectable object in the shape of a fly;

the kick tooth positioned on the top surface of the turntable with the radial distance between the kick tooth and the housing wall being less than the length, width or diameter of the ejectable object;

the turntable being rotatable at sufficient speed by a motor connected to the turntable such that the ejectable object is ejectable by engagement with the kick tooth and ejected through the aperture when the aperture is aligned with the ejection path of the ejectable object; and a hand-held apparatus sufficiently sized to make contact with the ejectable object.

* * * * *